United States Patent [19]

Sadler

[11] 4,072,293

[45] Feb. 7, 1978

[54] BOAT JACKS

[76] Inventor: Boyd Sadler, 3400 Browning Street, Victoria, British Columbia, Canada, V8P 4E1

[21] Appl. No.: 772,583

[22] Filed: Feb. 28, 1977

[51] Int. Cl.[2] ..... B66F 7/12

[52] U.S. Cl. ..... 254/89 R; 214/396

[58] Field of Search ..... 254/89 R, 89 H, 133, 254/134, 99, 45-50; 214/396, 12-14

[56] References Cited

U.S. PATENT DOCUMENTS

| | | | |
|---|---|---|---|
| 3,158,354 | 11/1964 | Ward | 254/89 R |
| 3,640,413 | 2/1972 | Klein | 214/396 |

*Primary Examiner*—Robert C. Watson

*Attorney, Agent, or Firm*—Charles J. Speciale

[57] ABSTRACT

Boat jacks operable in pairs to lift a boat off a wheeled carrier, each jack resting on a "T"-shaped base and supported by a tripod, each jack being specially modified by providing a horizontal lifting member on the front of the jack component that is movable up or down by a cranking arm, each horizontal lifting member being lodgable in longitudinally extending side channels provided on the hull of a boat, each base being clear of the boat, and a connecting chain provided between the horizontal lifting members to furnish additional lifting support to the jacks and to prevent their lateral movement one away from the other.

5 Claims, 2 Drawing Figures

BOAT JACKS

BACKGROUND OF THE INVENTION

1. Field of the Invention

This invention relates to a lifting jack structure and more particularly to an improved lifting jack structure suitable for lifting boats.

2. Description of the Prior Art

The lifting of boats on and off wheeled carriers is a headache common to all boat users. While a variety of lifting jacks are known for both boats and automobiles none has been found that provides a simple and efficient lifting jack system usable for lifting boats on and off wheeled carriers. Some typical existing jacks may be found in U.S. Pat. Nos. 2,997,292 (boat jacks for rotating a boat on its side); 3,114,535 (boat jack for lifting a boat out of water); 3,158,354 (jack for campers); 3,159,381 (automobile jack); 3,415,490 (jack for lifting campers and trailers); 3,749,361 (airplane jack); and 3,753,550 (jack for land vehicles). The foregoing are so complicated that their use is either inefficient uneconomical, or both.

SUMMARY OF THE INVENTION

It is, therefore, among one of the principal objectives of this invention to provide an improved lifting jack system for lifting boats onto or off wheeled carriers which is simple of construction yet is extremely effective.

In accord with the present invention there has now been provided a boat jack system involving boat jacks operable in laterally opposing pairs to lift a boat onto or off a wheeled carrier, each jack resting on a T-shaped base and supported by a tripod, each jack being specially modified by providing a horizontal lifting member on the front of the movable jack component, the latter movable by means of a cranking arm, each horizontal lifting member being lodgable in a longitudinally extending side channel provided on the hull of a boat, each T-shaped base being clear of the boat, and a connecting chain provided between the horizontal lifting members to furnish additional lifting support to the jacks and to prevent possible lateral movement between the two jacks. The tripod lifting jack is conventional in itself, however, the invention modifications are not.

BRIEF DESCRIPTION OF THE DRAWING

The invention will be hereinafter more fully described with reference to the accompanying drawing in which.

DETAILED DESCRIPTION OF THE PREFERRED EMBODIMENT

Figure 1:
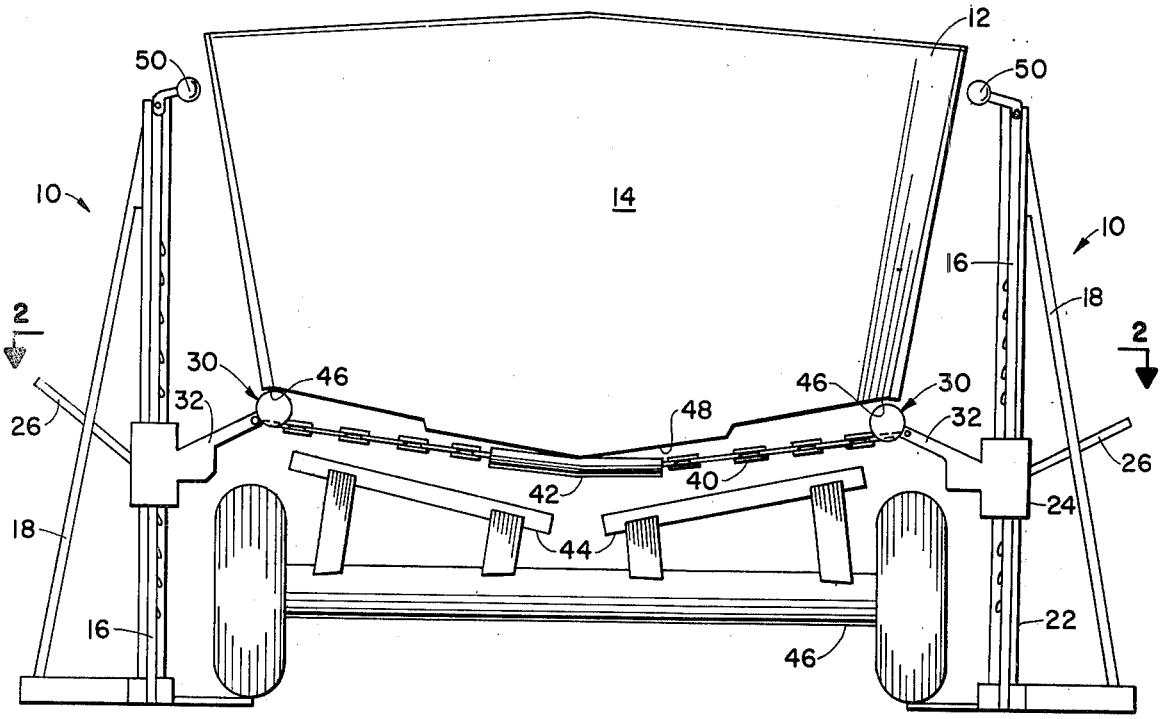
FIG. 1 is an elevated side plan view of the invention boat jacks as shown lifting the stern of a boat.
Figure 2:
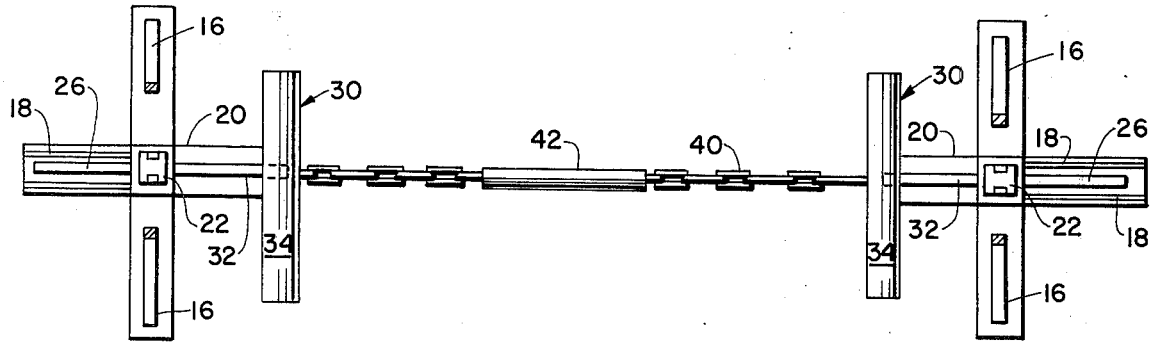
FIG. 2 is a top plan view of the invention boat jack system along line 2—2 of FIG. 1.

Referring now to the Figures of the drawing there is illustrated therein a pair of boat jacks 10 in lateral opposition with respect to the boat hull 12 whose stern portion 14 only is shown between the jacks 10. Each jack 10 is of the conventional tripod supported type, sometimes known as the "Jack-All-Jack". The front tripod members 16 and rear tripod members 18 rest on T-shaped base 20. The center pole 22 contains the conventional movable jack component 24 and its manually operated cranking arm 26. Up to this point, except for the T-shaped base, the jacks 10 are well known to the art. All parts are made of the usual steel or the like.

In accordance with the invention, movable jack component 24 is provided with a horizontal lifting member 30 mounted to a lifting bar 32. Member 30 is preferably a cylindrical short tube 34 welded to the lifting bar 32 which is in turn welded to the component 24. Lifting bar 32 is inclined upwardly at an angle to the horizontal.

A connecting chain 40 is mounted to each horizontal lifting member 30 and is made long enough to stretch across the width of the average boat hull as will be seen hereinbelow. Intermediate the ends of the chain in a generally central location is mounted a short steel tube 42 to add further strength to the chain. The chain can be detachably mounted such as by removably hooking it to the lifting bar 32 or it can be welded permanently, either is preferred.

Describing now the operation of the invention and referring particularly to FIG. 1, a boat hull 12 is shown in the process of being lifted off the boat bunks 44 conventionally found on a wheel carrier 46. The manner in which this is done is to straddle the hull stern portion 14 (which extends rearwardly of the end of the carrier 46) with the jacks 10 so that they are in lateral opposition. In many boat hulls there are found longitudinally extending curved side channels 46. The horizontal members 30 are shaped cylindrically to seat therein and are raised vertically by the cranking arm 26 until they are so situate. Meanwhile, the chain 40 is being raised at the same time and comes to abutting contact via its tube 42 to the bottom 48 of the hull. Chain 40 not only adds further support the horizontal lifting member but can provide also all the lifting power when the boat hull does not have side channels 46. By virtue of the T-shaped base 20 the wheels of the carrier will comfortably clear the jacks if the boat hull doesn't extend out from the rear of the carrier.

While one pair of boat jacks has been demonstrated it is clear that more than one pair may be used if necessary. A pair of these jacks may be employed to raise and lower boats between about 10 to 38 feet long. A pair of laterally opposed rollers 50 may be provided at the end of the center pole 22 which will be useful if the boat hull tilts while being raised to prevent scratching of the hull and preventing further tilting. I claim:

1. In a boat jack system involving boat jacks operable in laterally opposing pairs to lift a boat onto or off a carrier therefor, each boat jack including a tripod support, a center pole containing a vertically movable jack component and a manually operable cranking arm for moving said jack component, the improvement which comprises providing a T-shaped base for said tripod support, the top of the "T" facing the front of said jack, a horizontal tubular lifting member being mounted to a lifting bar therefor, said lifting bar mounted in turn to said movable jack component, an elongated chain detachably mountable to and between each said horizontal lifting member and lifting bar, intermediate the ends of said chain in a generally central position there being mounted a support tube, said elongated chain providing simultaneous lifting support to said jacks and prevention of their lateral movement when liftingly engaged with said boat.

2. The apparatus according to claim 1 wherein said elongated chain is permanently mounted to and between each said lifting bar.

3. The apparatus according to claim 1 wherein said lifting bar is angularly inclined upwardly raising said horizontal member.

4. The apparatus according to claim 3 wherein a roller is provided at the top end of said center pole.

5. The apparatus according to claim 1 wherein at least one pair of boat jacks is employed.

* * * * *